US005921660A

United States Patent [19]

Yu

[11] Patent Number: 5,921,660

[45] Date of Patent: Jul. 13, 1999

[54] ELECTRIC BULB FOR IDENTIFICATION LAMP

[76] Inventor: William Yu, 12310 Herrington Manor Dr., Silver Spring, Md. 20904

[21] Appl. No.: 09/000,869

[22] Filed: Dec. 30, 1997

[30] Foreign Application Priority Data

Jan. 2, 1997 [CN] China ..... 97 2 04601

[51] Int. Cl.[6] ..... F21V 21/00

[52] U.S. Cl. ..... 362/249; 362/226; 362/227; 362/800; 362/269; 362/427

[58] Field of Search ..... 362/226, 269, 362/800, 227, 806, 427, 249; 215/321

[56] References Cited

U.S. PATENT DOCUMENTS 5,195,904 3/1993 Cyvoct ..... 439/349
5,463,280 10/1995 Johnson ..... 315/187
5,506,760 4/1996 Giebler ..... 362/249
5,575,459 11/1996 Anderson ..... 362/240
5,607,190 3/1997 Exandier ..... 285/93

*Primary Examiner*—Sandra O'Shea
*Assistant Examiner*—Marshall Honeyman

[57] ABSTRACT

An electric bulb for identification lamp comprising a bulb head, a bulb body, a plurality of light emitting diodes (LEDs) setting over the peripheral surface surrounding said bulb body, and a power supply unit to feed said LEDs, wherein, said power supply unit is set within said bulb body, and said bulb further comprises a connector with one end fixed connected to said bulb head, while another end rotably connected to said bulb body by apply a proper torque. Therefore, the advantages of such bulb are low power consumption and long lift-time, as well as light distribution well with emitting direction adjustable by rotating its body to show a noticeable identification with soft light to the viewers from both side. It also applicable for any lamps where the adjustment of light emitting direction is required.

2 Claims, 4 Drawing Sheets

ELECTRIC BULB FOR IDENTIFICATION LAMP

BACKGROUND OF THE INVENTION

1. Field of the Invention

The invention relates to the bulb of an electric lamp, and particularly, the invention relates to an electric bulb for an identification lamp or an ID lamp bulb.

2. Background of the Invention

Generally, an identification lamp comprises a bulb and a flat lantern case for accomodating the bulb to show noticeable identifications on its panels with emitting and shadowing patterns.

The ID lamp bulb known today is an incandecent bulb usually. As a point-source bulb, the light from ID lamp is not well-distributed with a troublesome beam spot suffered by observers. Furthermore, the bulb suffers from high power consumption and short life-time.

SUMMARY OF THE INVENTION

As the problems described above, one object of the invention is to provide an ID bulb with low power consumption, long life-time and well-distrubion light.

Another object of the invention is to provide an ID lamp comprising said bulb.

To achieve these objects, an ID lamp bulb according to the invention, includes a bulb head, a bulb body, a plularity of light emitting diodes (LEDs) setting over the peripheral surface surrounding said bulb body, and a power supply unit to feed said LEDs, wherein, said ID lamp bulb further includes a connector with one end fixed connected to said bulb head, while another end rotably connected to said bulb body by applying a proper torque, and within said bulb body, said power supply is set.

As the configuration described, an ID lamp bulb according to the invention has the advantage of light distribution well with emitting direction adjustable by rotating its body as well as low power consumption and long lift-time. It is applicable not only to ID lamps but also for any lamps where adjustment of light emitting direction is required.

BRIEF DESCRIPTION OF THE DRAWINGS

The features, objects, and advantages of the invention will become more apparent from the detailed description set forth below taken in conjunction with the drawings, wherein.

DETAILED DESCRIPTION OF PREFERRED EMBODIMENTS

Figure 1:
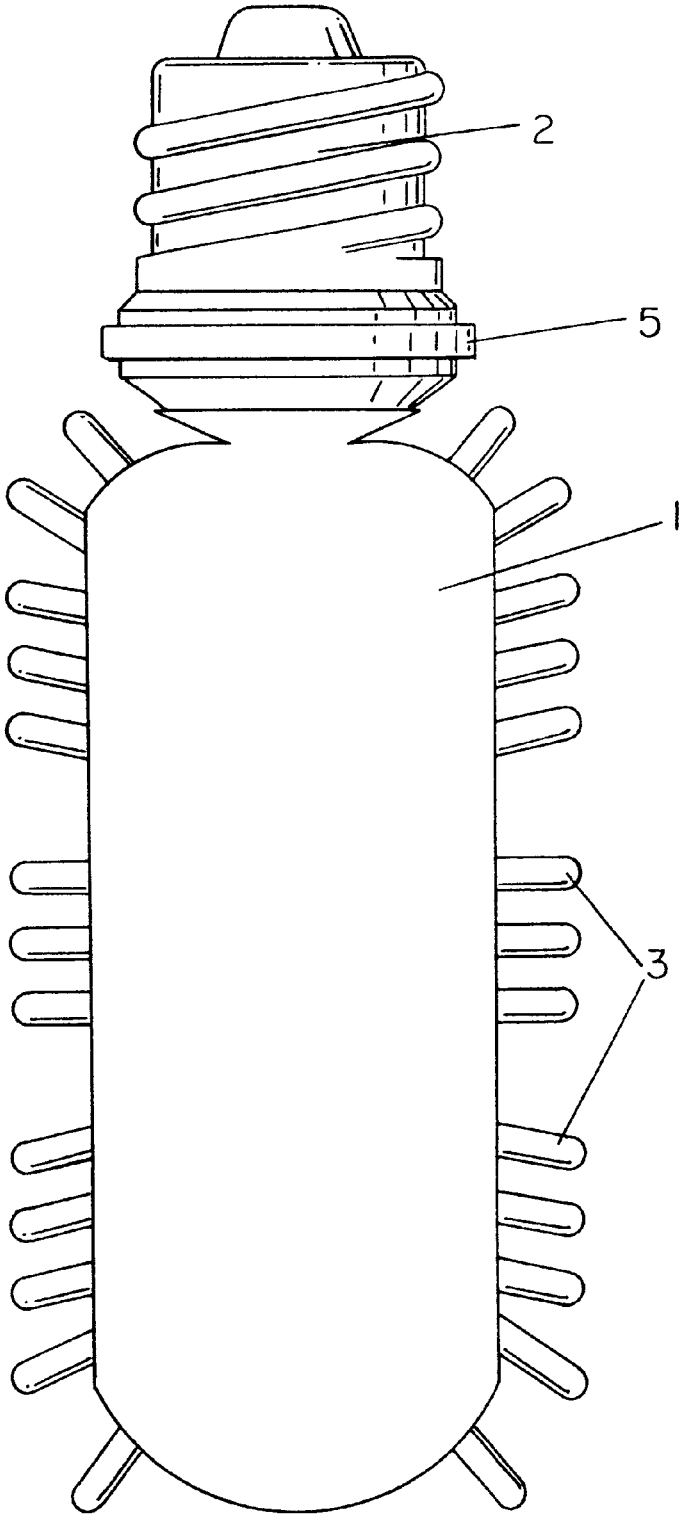
FIG. 1 is an overall drawing of an embodiment of ID lamp bulb according to the invention.

As shown in FIG. 1, an ID lamp bulb (referred to briefly as "bulb" below) according to the invention—consists of a bulb body 1, a bulb head 2, a plularity of LED 3, and a power supply unit (not shown in FIG. 1) setting within bulb body 1 for LED 3. This bulb further includes a connector 5 with one end fixedly connected to the bulb head 2, while other end is rotatably connected the bulb body 1 by applying a proper torque.

Figure 2:
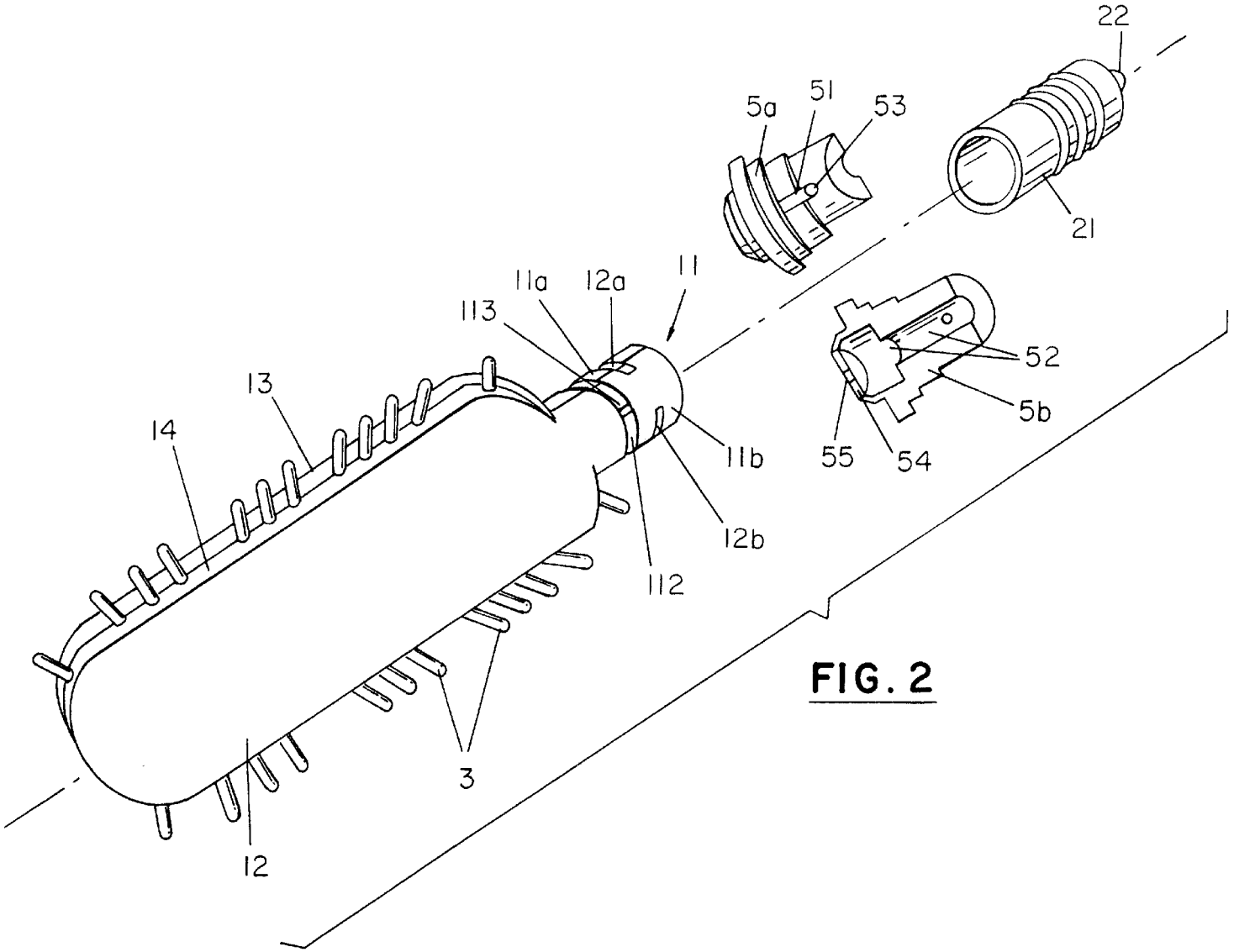
FIG. 2 is an exploded view of ID lamp bulb showing in FIG. 1.

FIG. 2 it is a schematic view of a bulb according to the invention. As shown in FIG. 2, the connector 5 consists of two connectors (i.e. front connector 5*a* and back connector 5*b*) face to face coupling together, each having identical multi-step-shaped nearly half-cylinder appearance. On the outside step surface at the side connected to bulb head 2 of front connector 5*a* and/or back connector 5*b*, there is a wiring slot 51 with a wiring hole 53 through to hollow section 52 of connector 5 at one end. When such side of connector 5 is fixed on the bulb head 2, one input lead of power supply unit 4 in bulb body 1 is held into wiring slot 51 through wiring hole 53 via hollow section 51, and fastened by metal package 21 of bulb 2 for electrical connection, while another input lead is welded on contact 22 of bulb head 2 through hollow section 52. Bulb head 2 in various diameter size can be pushed down and held on different outside step surfaces of connector 5 respectively.

One side of bulb body 1 forms a cylindrical connection end 11 with a ring slot 112, having at least one lug 113, around its outside surface. On the inner surface of hollow section 52 at another side of connector 5, there is a convex ring 54 having at least one boss 55. When bulb body 1 is connected to the another side of connector 5 by its connection end 11, the convex ring 54 in connector 5 joins with ring slot 112 on connection end 11 of bulb body 1, and the bulb body 1 may be rotated relative to the connector 5 by applying a proper torque. It is necessary to set a proper torque to ensure a light emitting position stability of the bulb can be obtained after rotating adjustment. The larger torque is set, the higher position stability will be obtained. However, if the torque is too large, there will tend to be bulb slippage from its screw socket during reverse rotating adjustment of light emitting position of the bulb, thus, the adjustment will be impossible. Therefore, the torque is typically smaller than the torque to fasten the bulb on its socket, and set to such a value that a practical position stability can be available. This rotation torque is corresponding to the rotational friction generated by dimension coordination between convex ring 54 and ring slot 112.

When the bulb is screwed on a socket (not shown) by its bulb head 2, the lug 113 in ring slot 112 and the boss 55 on convex ring 54 become the stopper of rotation.

Referring to FIG. 2 again, the bulb body 1 consists of a pair of long and flat cases (i.e. front case 12 and back case 13) coupling together. The cylindrical connection end 11 of bulb body 1 also consists of a pair of front and back half-cylinders 11*a*, 11*b* which are integrated with such front case 12 and back case 13 respectively, and coupled together. The power supply unit 4 is set into bulb body 11 formed by front and back case 12, 13.

As shown in FIG. 2, on the coupling boundary between case 12 and case 13 along the longitudinal center line of peripheral surface 14 surrounding bulb body 1, a plurality of LEDs 3 are distributed somewhat evenly with their optical axes located approximately within the bind surface of case 12 and case 13. The more the LEDs 3 shift from the middle of peripheral surface 14, the more their optical axes decline to both ends of such surface.

On the cylindrical connection end 11 of bulb body 1, two clutching slots 12*a*, 12*b*, each having a bottom surface as vertical plane to the bind surface of case 12 and case 13, are formed corresponding to peripheral surface 14. In case of no connector nor bulb head required, the clutching slots 12*a*, 12*b* are used to connect the rack (not shown) in lantern case to install bulb body 1 into the ID lamp.

Figure 3:
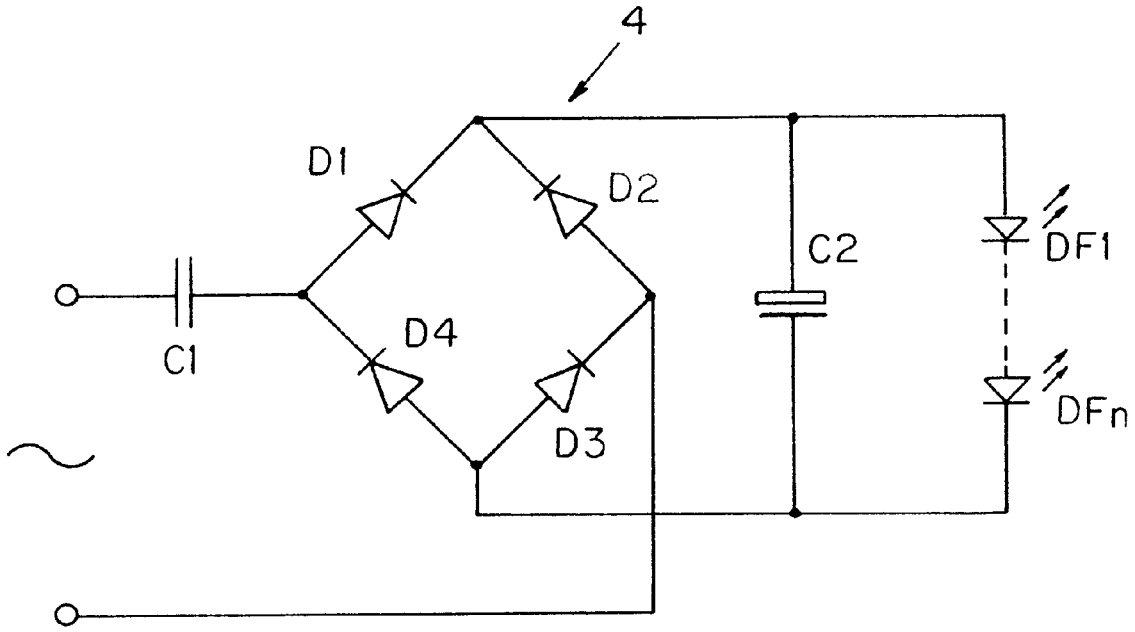
FIG. 3 is a power supply circuit diagram for said embodiment.

Next referring to FIG. 3, it is a circuit diagram of power supply unit 4 according to the invention. As shown in FIG. 3, the rectifier circuit for power supply unit 4 consists of four bridged diodes D1, D2, D3 and D4, a current limitting capictor C1 serial connected in its AC input, and a filter parallel connected in its output to supply power serially for LEDs33 (DF1, DF2 . . . DFn). It has the advantages of less components and simple circuit configuration.

In above sections, the detailed description for the first embodiment of the invention as shown in FIG. 1, FIG. 2 and FIG. 3 have been made. However, the configurations of such embodiment can be further changed as follows.

(1) The ring slot 112 on connection end 11 of bulb body 1 and the convex ring 54 in connector 5 are exchangeable, namely, in the original place of convex ring 54, the ring slot 112 can be set, and the convex ring 54 can set in the original place of ring slot 112. Such replacement does not change the original performances of the bulb.

(2) The bulb body 1 can be configured as a single main case with one side surface opened, and the connection end 11 of bulb body 1 will be a complete body integrated with such main case, rather than the seperated configuration such as front and back half-cylinders 11*a*, 11*b* described above. Then a removable cover can be installed for the opened side surface. This exemplary change of bulb body 1 has the advantage of easy maintenance and replacement for power supply unit 4 within bulb body 1 and LEDs 3 on surface 14, and easy installation of wheel-type bulb head.

(3) In addition to screw-type, the bulb head 2 may be in clutching-type (bayonet-capped) and other standard types.

(4) It is possible that the configuration of case 12 and case 13 of bulb body 1 are similar, and such two similar cases are jointed together by mutural insertion with removeable pins. Thus, the dies will be saved, and the maitenance will be easy.

Figure 4:
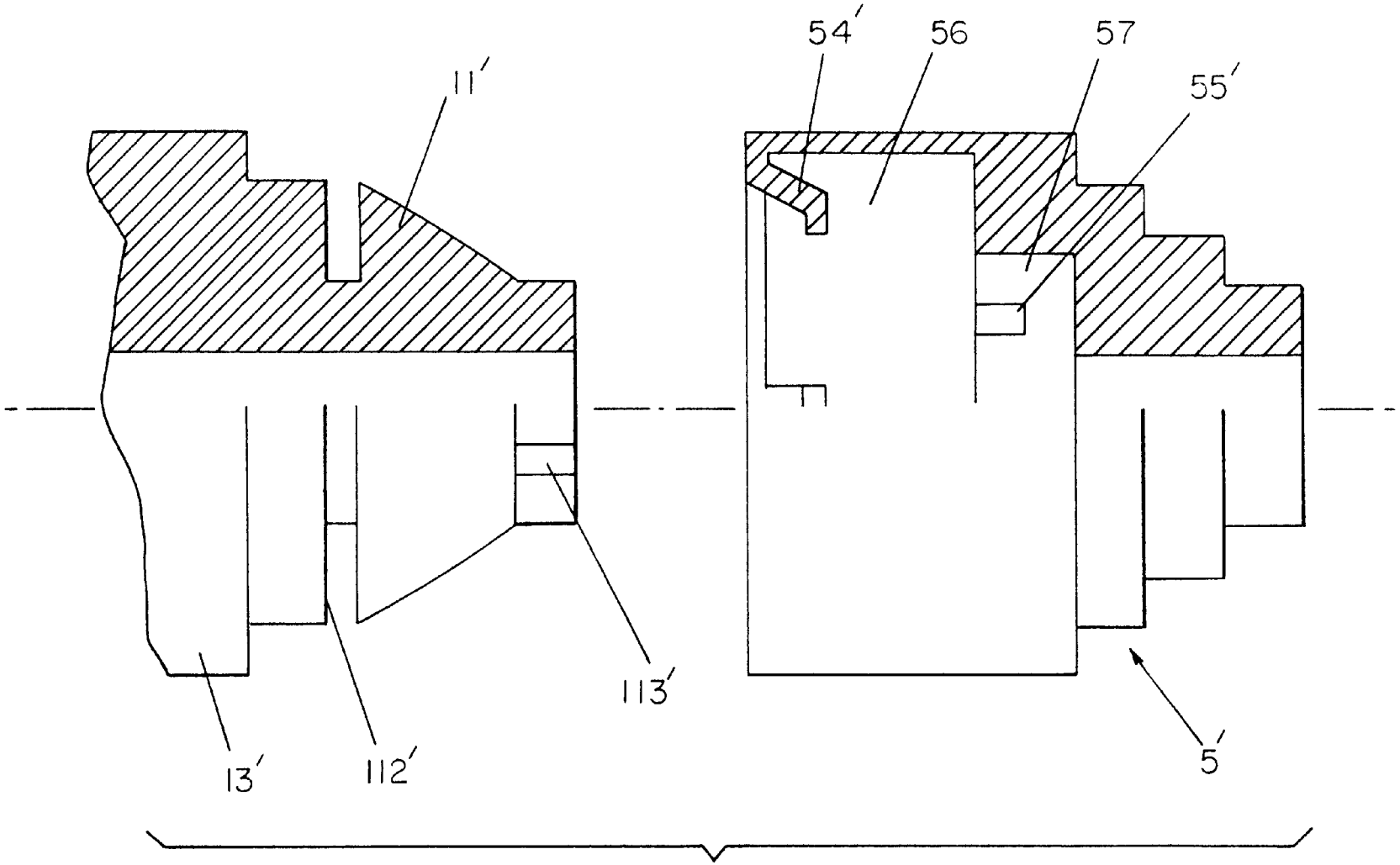
FIG. 4 is a schematic diagram showing the construction of connector and bulb body connecting ends in another embodiment of ID lamp bulb according to the invention.

Now, referring to FIG. 4, it is a schematic diagram showing the configuration of another embodiment of bulb body connection end and connector in ID lamp bulb according to the invention. As shown in FIG. 4, the connection end 11 integrated with main case 13 of bulb body 1 is a bowl-shaped cylinder with a ring slot 112 around its wide section surface and a lug 113' on its narrow section surface. Connector 5' is a multi-steps tube with two cylindrical inner surfaces 56,57 steps toward the narrow section of connector end 11'. A plularity of spring claws 54', e.g. 4 sping claws, are formed on the edge of cylindrical inner surface 56, and a boss 55' is formed on the cylindrical inner surface 57. In the assembling process the bowl-shaped section of connection end 11' is so inserted into the cylindrical inner surfaces 56, 57 as spring claws 54' clutch at the ring slot 112' to enable the bulb body 1 to be rotated relatively to connector 5' by applying a proper torque to it, and to be stopped by lug 113' and boss 55' performing as stopper.

The bulb according to the invention is capable of fitting in any existing ID lamp to replace the incandesent bulb. In the fitting process, after the screw-type or bayonet-capped type bulb head 2 is screwed on or inserted into the socket in lantern case, the bulb body 1 is twisted reversly with your hand until the flat main surfaces of bulb body 1 are parallel to the front and back pannel of the lantern case, and the fitting is completed. In such condition, the optical axis of each LED3 is not directed to the front and back panel showing the identification, so it can be prevented from casting a light directly to the viewers' eyes, and the lamp is emitting a well-distributed light around the light source, since these optical axes decline to each end side as the LEDS 3 shift from the middle for the bulb body 1. Furthermore, the LEDs 3 are distributed well around the bulb body 1, therefore, a well-distributed diffusion light illuminates from the front and back panels of ID lamp without any beam spot, showing a noticable identification with soft light to the viewers from both sides.

Thus, an electric bulb for an identification lamp according to the invention is described in detailed.

Various alternative embodiments of the invention will be apparent to one skilled in the art. The exemplary embodiments provided above is merely for purposes of illustration and should not be taken as limiting the scope of the invention.

I claim:

1. A bulb for an identification lamps, said bulb comprising:

a bulb head;

a bulb body, said bulb body having a plurality of light emitting diodes surrounding said bulb body, a power simply unit connected to said light emitting diodes and set within said bulb body, a connection end of said bulb body, said connection end having a pair of clutching slots and a ring slot, said ring slot having at least one lug, and a connector, said connector having one end fixedly connected to said bulb head and a second end rotatably connected to said bulb body, said connector having an inner surface with a convex ring and a boss, which join with said ring slot on said connection end of said bulb body to limit rotation of said bulb.

2. A bulb for an identification lamps, said bulb comprising:

a bulb head;

a bulb body, said bulb body having a plurality of light emitting diodes surrounding said bulb body, a connection end, said connection end having a wide section surface and a ring slot around said wide section surface, said connection end having a narrow section surface and a lug on said narrow section surface, and a connector, said connector having a cylindrical inner surface, said connector having a plurality of spring claws and a boss formed on said cylindrical inner surface, said spring claws clutching at said ring slot to enable said bulb to be rotated relative to said connector and stopped by engagement of said lug and said boss.

* * * * *